US008769780B1

(12) United States Patent
Segel

(10) Patent No.: US 8,769,780 B1
(45) Date of Patent: Jul. 8, 2014

(54) SHIRT TAIL RETENTION DEVICE AND METHOD

(76) Inventor: Alan Segel, Bryn Mawr, PA (US)

( * ) Notice: Subject to any disclaimer, the term of this patent is extended or adjusted under 35 U.S.C. 154(b) by 309 days.

(21) Appl. No.: 13/472,992

(22) Filed: May 16, 2012

(51) Int. Cl.
*A41F 1/00* (2006.01)
*A44C 13/00* (2006.01)

(52) U.S. Cl.
USPC ..... 24/302; 24/299; 24/300; 24/301; 24/303; 63/1.18; 63/900; 63/41

(58) Field of Classification Search
None
See application file for complete search history.

(56) References Cited

U.S. PATENT DOCUMENTS

| | | | | |
|---|---|---|---|---|
| 761,493 | A * | 5/1904 | Ingalls | 24/299 |
| 789,234 | A * | 5/1905 | Rice | 24/299 |
| 2,036,743 | A * | 4/1936 | Cohn | 24/299 |
| 2,114,222 | A | 10/1936 | Holben | |
| 2,592,395 | A | 4/1952 | Cummings | |
| 5,276,923 | A | 1/1994 | Cohen | |
| 6,175,993 | B1 | 1/2001 | Gilman et al. | |
| 6,397,393 | B2 | 6/2002 | Alger | |
| 6,962,063 | B1 * | 11/2005 | Pearl | 63/3.2 |
| 7,373,696 | B2 | 5/2008 | Schoening et al. | |
| 7,409,730 | B2 | 8/2008 | Boos | |
| 7,793,518 | B1 * | 9/2010 | Holleman | 63/33 |
| 7,992,264 | B2 | 8/2011 | Abadi | |
| 8,113,013 | B2 * | 2/2012 | Kessler | 63/40 |
| 2004/0111005 | A1 * | 6/2004 | Lu | 600/15 |
| 2004/0200236 | A1 * | 10/2004 | Emberson et al. | 63/23 |
| 2006/0010559 | A1 | 1/2006 | Hamlet | |
| 2006/0032026 | A1 | 2/2006 | Schoening et al. | |
| 2006/0174649 | A1 * | 8/2006 | Azrielant | 63/14.1 |
| 2010/0235969 | A1 | 9/2010 | Isaacson et al. | |
| 2011/0083254 | A1 | 4/2011 | Trutna et al. | |
| 2011/0094063 | A1 | 4/2011 | Dong | |
| 2011/0167540 | A1 | 7/2011 | Little | |
| 2012/0125046 | A1 * | 5/2012 | Vander Wal et al. | 63/1.18 |
| 2012/0299674 | A1 * | 11/2012 | Montone | 335/285 |
| 2013/0298356 | A1 * | 11/2013 | Scandora | 24/303 |

FOREIGN PATENT DOCUMENTS

| | | |
|---|---|---|
| JP | 2008115484 | 5/2008 |

* cited by examiner

*Primary Examiner* — Jack W. Lavinder
(74) *Attorney, Agent, or Firm* — Caesar, Rivise, Bernstein, Cohen & Polotilow, Ltd.

(57) ABSTRACT

A device for retaining tails of a shirt in a pair of pants is provided including a first magnetic component, a second magnetic component and a third magnetic component. The first magnetic component is attracted to the second magnetic component and the second magnetic component is attracted to the third magnetic component. A first cord is connected to the first magnetic component and the second magnetic component and a second cord is connected to the second magnetic component and the third magnetic component. A method of using the device is also provided.

5 Claims, 4 Drawing Sheets

SHIRT TAIL RETENTION DEVICE AND METHOD

BACKGROUND OF THE INVENTION

The present invention is directed to a garment securing device. In particular, the present invention is directed to a device and method for retaining shirt tails in a pair of pants.

Various devices for retaining shirt tails in a pair of pants are known. For example, U.S. Pat. No. 2,114,222 (Holben) discloses a shirt stay disposed adjacent to the inside waist of a pair of pants that has grip surfaces to help keep the tails of a shirt from slipping out.

U.S. Pat. No. 5,276,923 (Cohen) discloses a shirt hold-down device that utilizes a large elastomeric web to accommodate a user's groin area and has fasteners to secure the web to a user's shirt.

U.S. Patent App Pub. No. 2010/0235969 (Isaacson et al.) is directed to an undergarment that includes elongated loops having fasteners that attach to the bottom of the shirt tails of a shirt to secure the shirt tails in place.

U.S. Patent App. Pub. No. 2011/0094063 (Dong) is directed to an adjustable shirt tuck clip. The clip attaches to a shirt to adjust its waist size to neatly tuck the excess in the user's trousers.

U.S. Patent App. Pub. No. 2006/0010559 (Hamlet) is directed to a self tucking shirt mechanism that utilizes a special nap that dynamically urges the shirt into the pants.

U.S. Pat. No. 6,175,993 (Gilman et al.) is directed to a shirt locking device that includes a fastening device and a weight. The fastening device affixes the bottom portion of a shirt in a tucked position against an undergarment.

U.S. Pat. No. 6,397,393 (Alger) is directed to a combination of a shirt and a pair of pants that are fastened together by a self-releasing bond.

It would be beneficial to provide a shirt tail retention device that is inexpensive, simple to use, nonintrusive, requires no laundering, and can easily be used with multiple pairs of pants.

All references cited herein are incorporated herein by reference in their entireties.

BRIEF SUMMARY OF THE INVENTION

A device for retaining tails of a shirt in a pair of pants is provided. The device includes a first magnetic component, a second magnetic component and a third magnetic component. The first magnetic component is attracted to the second magnetic component and the second magnetic component is attracted to the third magnetic component. A first cord is connected between the first magnetic component and the second magnetic component. A second cord is connected between the second magnetic component and the third magnetic component.

Each of the first magnetic component, the second magnetic component and the third magnetic component may be a magnet disposed inside a decorative magnet holder. Each decorative magnet holder may be in the shape of a polygon (such as an octagon). The first cord and the second cord may be made from, for example, nylon filament.

A method for retaining tails of a shirt in a pair of pants on a user is also provided. The method first includes the step of providing the shirt worn by the user. The shirt has a front placket closed by a button down closure that extends from a front collar of the shirt to a front tail of the shirt. The front placket has an inside and an outside. The shirt is in a buttoned condition. The method continues with the step of providing the pair of pants worn by the user. The pair of pants has a fly having a fly underflap disposed between the user and a zipper of the fly. The zipper is initially in an unzipped condition. The fly underflap has an inside adjacent to the user and an outside. The zipper is disposed on the outside of the fly underflap. The method continues with the step of providing a device for retaining the tails of the shirt in the pair of pants as described above. The first magnetic component is placed between the inside of the front placket on the front tail of the shirt. The second magnetic component is placed on the outside of the front placket over the first magnet such that the first magnetic component is attracted to the second magnetic component through the front placket to hold the first magnet and second magnet securely in place on the front placket. The third magnetic component is placed on the outside of the fly underflap in a position adjacent to the first magnetic component and the second magnetic component. The third magnetic component is attracted to the second magnetic component. The first, second and third magnetic components are, therefore, secured together with the pants and shirt sandwiched between them to hold the shirt securely to the pants. The zipper may then be zipped. A user can easily adjust the degree of retention of the shirt tails.

Placketless shirts such as polo shirts and T-shirts may also be used with this device. However, the first and or second cord must be sufficiently long to go under the bottom hem of the shirt.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The invention will be illustrated in more detail with reference to the following embodiment, but it should be understood that the present invention is not deemed to be limited thereto.

Figure 1:
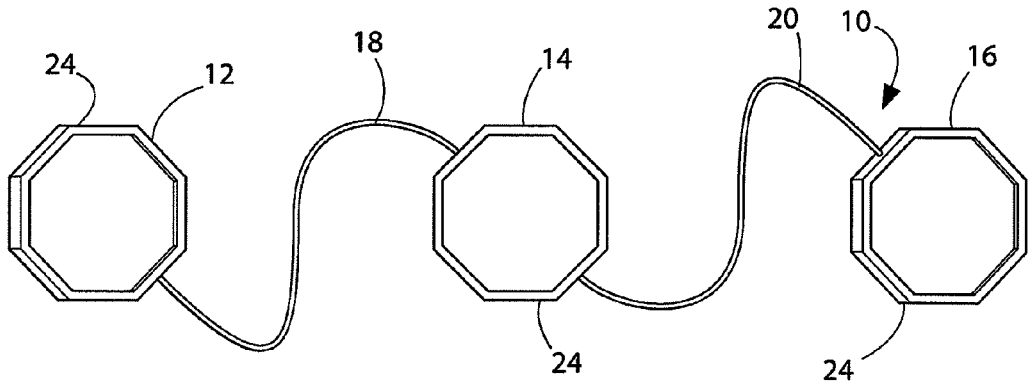
FIG. 1 is an isometric view of a shirt tail retention device in accordance with a first exemplary embodiment of the present invention.
Figure 2:
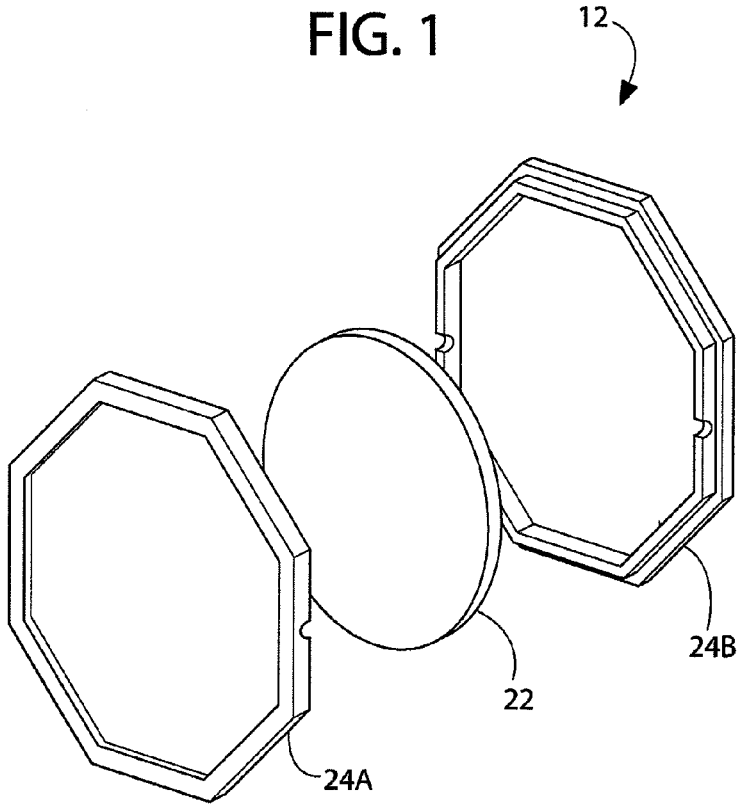
FIG. 2 is an exploded isometric view of a magnetic component of the shirt tail retention device of FIG. 1.

Referring now to the drawing figures, wherein like part numbers refer to like elements throughout the several views, there is shown in FIGS. 1 and 2 a device for retaining tails of a shirt in a pair of pants 10 in accordance with an exemplary embodiment of the present invention. The device for retaining tails of a shirt 42 includes a first magnetic component 12, a second magnetic component 14 and a third magnetic component 16. The magnetic components 12, 14, 16 can be identical or be different in ornamental appearance. The first magnetic component 12 is adapted to be attracted to the second magnetic component 14 and the second magnetic component 14 is adapted to be attracted to the third magnetic component 16. A first cord 18 is disposed between the first magnetic component 12 and the second magnetic component 14 attaching them together. A second cord 20 is disposed between the second magnetic component 14 and the third magnetic component 16 attaching them together.

As shown in FIG. 1, each of the first magnetic component 12, the second magnetic component 14 and the third magnetic component 16 may be a magnet 22 disposed inside a decorative magnet holder 24, for example, in the form of two halves 24A, 24B, as shown in FIG. 2. Additionally, as shown, the decorative magnet 24 holder may be in the shape of, for example, a polygon, such as an octagon. The first cord 18 and the second cord 20 may be any type of appropriate string or cord, such as nylon filament.

Figure 3:
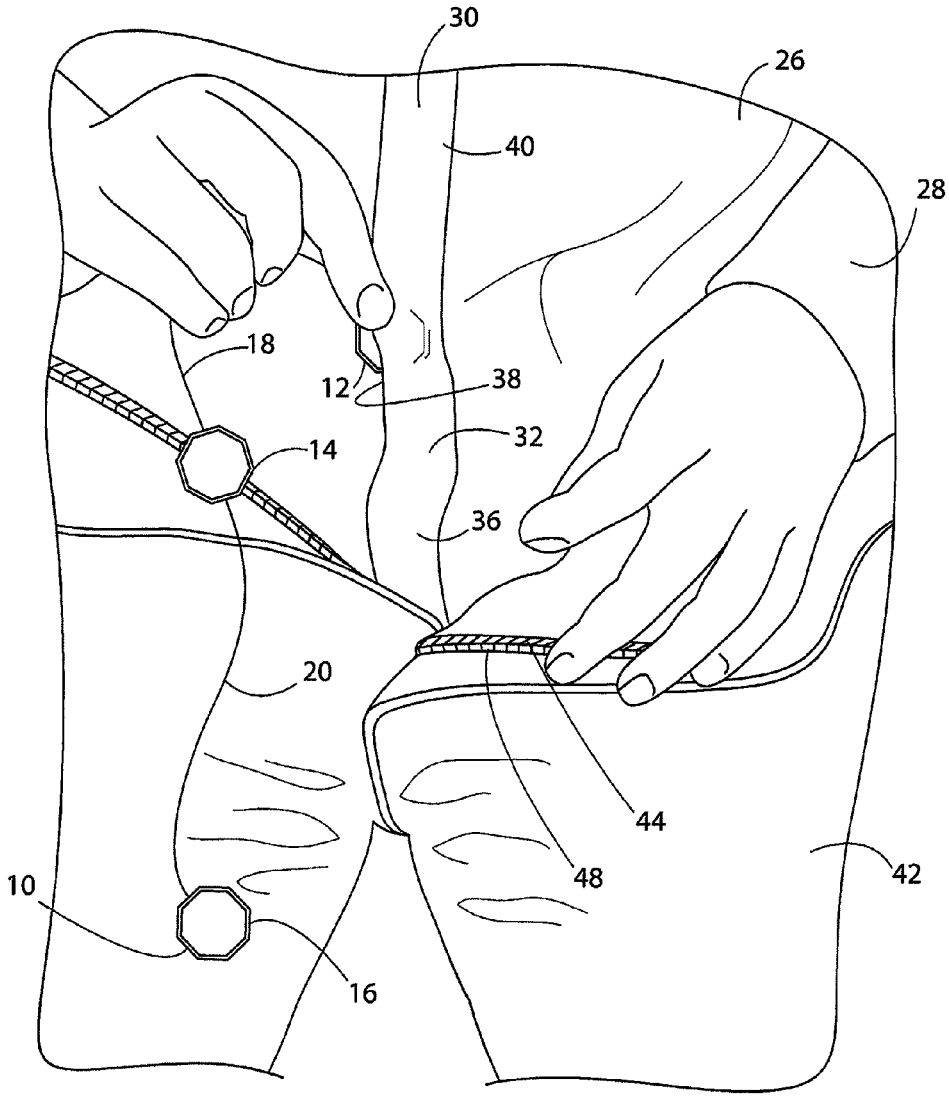
FIGS. 3, 4 and 5 are isometric views of the shirt tail retention device of FIG. 1 as used by a user, which depict, in order, a method of using the shirt tail retention device.
Figure 4:
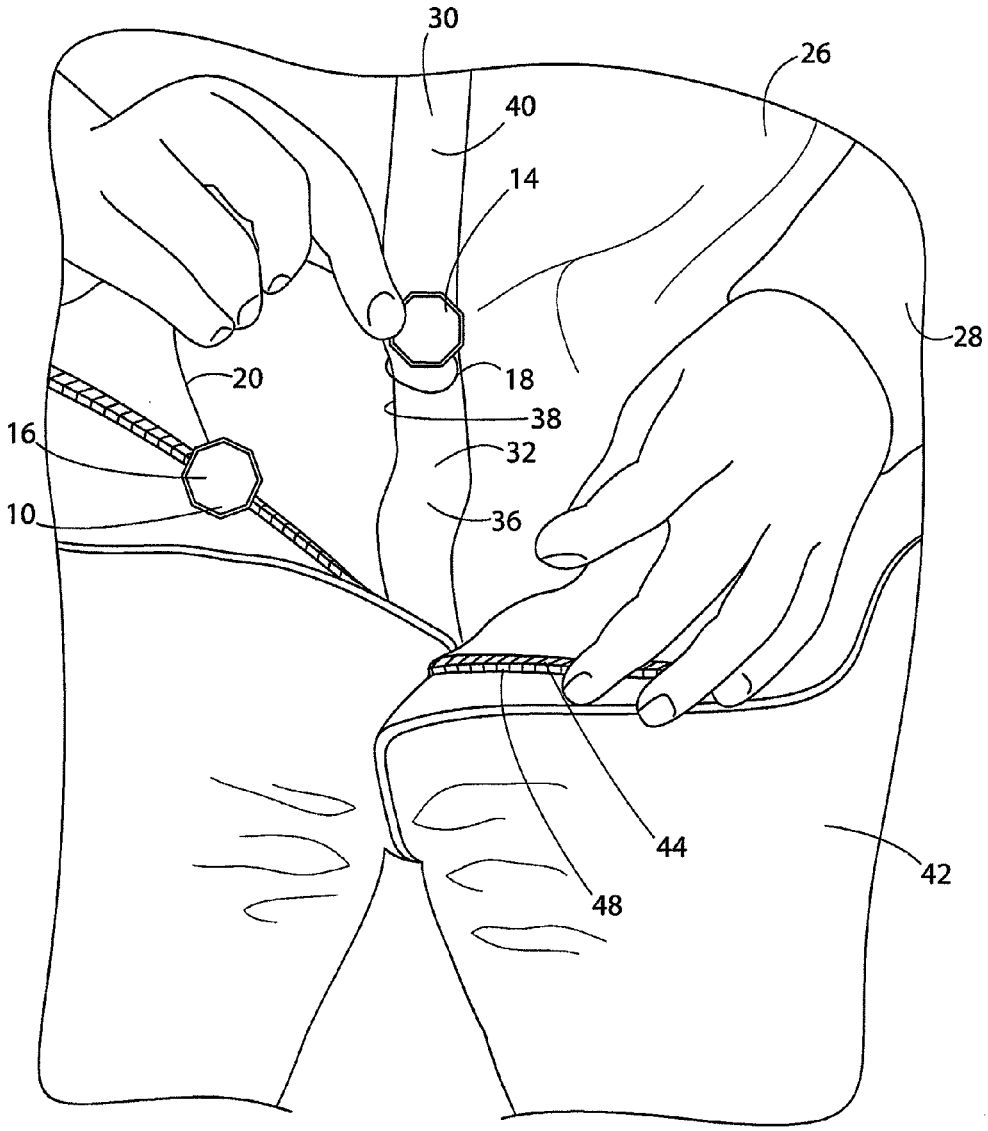
Figure 5:
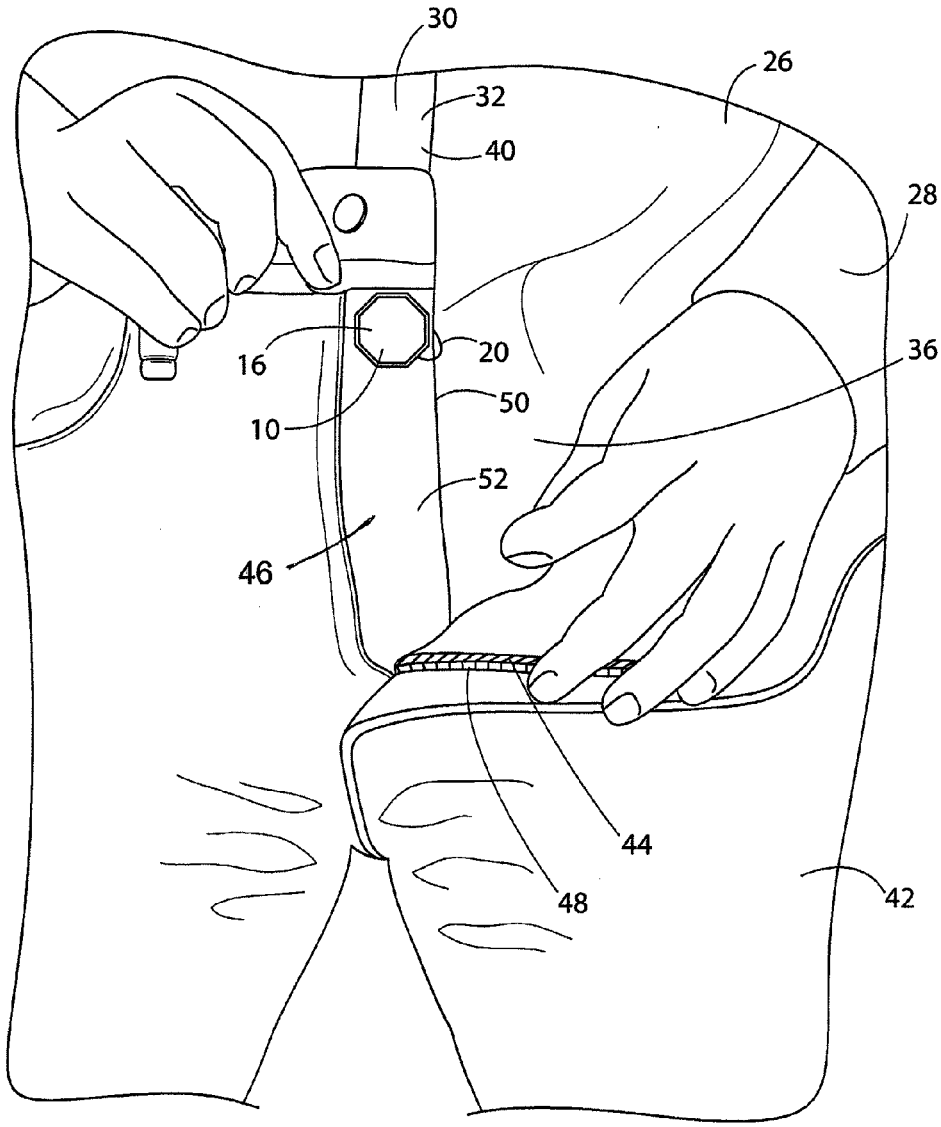

As shown in FIGS. 3-5, a method for retaining tails of a shirt in a pair of pants using the device 10 as described above is also disclosed. The method consists of the steps of providing a shirt 26 worn by the user 28. The shirt 26 has a front placket 30 closed by a closure such as a button down closure 32 from a front collar (not shown) of the shirt 26 to a front tail 36 of the shirt 26. The front placket 30 has an inside 38 and an outside 40. The shirt 26 is in a buttoned condition at the start of the method. A pair of pants 42 worn by the user has a fly 44. The fly 44 has a fly underflap 46 disposed between the user 28 and a zipper 48 of the fly (for purposes of the present invention, the "zipper" is also intended to include in its definition a button closure). The zipper 48 is initially in an unzipped condition. The fly underflap 46 has an inside 50 adjacent to the user's 28 torso and an outside 52. See FIG. 5. The zipper 48 is disposed on the outside 52 of the fly underflap 46. The method also includes the step of providing the device for retaining the tails of the shirt in the pair of pants 10, as described above, including all of its elements.

As shown in FIG. 3, the method continues with the steps of placing the first magnetic component 12 between the inside 38 of the front placket 30 on the front tail 36 of the shirt 26. Next, as shown in FIG. 4, the second magnetic component 14 is placed on the outside 40 of the front placket 30 over the first magnetic component 12 such that the first magnetic component 12 is attracted to the second magnetic 14 component through the front placket 30 to hold the first magnetic component 12 and second magnetic component 14 securely in place on the placket 30. Finally, as shown in FIG. 5, the method continues with the step of placing the third magnetic component 16 on the outside 52 of the fly underflap 46 in a position adjacent to the first magnetic component 12 and the second magnetic component 14. The third magnetic component 16 is attracted to the second magnetic component 14. The front tail 36 is held securely in place to the fly underflap to resist the pulling out of the front tail 36 from the pants 42.

While the invention has been described in detail and with reference to specific embodiments thereof, it will be apparent to one skilled in the art that various changes and modifications can be made therein without departing from the spirit and scope thereof.

What is claimed is:

1. A device for retaining tails of a shirt in a pair of pants, comprising:

(a) a first magnetic component, a second magnetic component and a third magnetic component, the first magnetic component attracted to the second magnetic component and the second magnetic component attracted to the third magnetic component, each of the first magnetic component, the second magnetic component and third magnetic component having a holder having a planar front surface and a planar rear surface;

(b) a first cord connected to the first magnetic component and the second magnetic component;

(c) a second cord connected to the second magnetic component and the third magnetic component;

(d) wherein the first magnetic component is connected only to a first end of the first cord, the second magnetic component is connected to a second end of the first cord and a first end of the second cord, and the third magnetic component is connected only to a second end of the second cord; and (e) wherein the planar front surface and the planar rear surface of each holder is disposed parallel to a longitudinal axis of the first cord and the second cord.

2. The device for retaining tails of a shirt in a pair of pants of claim 1, wherein each of the first magnetic component, the second magnetic component and the third magnetic component is a magnet disposed inside a decorative magnet holder.

3. The device for retaining tails of a shirt in a pair of pants of claim 2, wherein each decorative magnet holder is in the shape of a polygon.

4. The device for retaining tails of a shirt in a pair of pants of claim 1, wherein each of the first cord and the second cord is a nylon filament.

5. A method for retaining tails of a shirt in a pair of pants on a user, comprising:

(a) providing a shirt worn by the user, the shirt having a front placket closed by a button down closure from a front collar of the shirt to a front tail of the shirt, the front placket having an inside and an outside, the shirt being in a buttoned condition;

(b) providing the pair of pants worn by the user, the pair of pants having a fly, the fly having a fly underflap disposed between the user and a zipper of the fly, the zipper initially being in an unzipped condition, the fly underflap having an inside adjacent to the user and an outside, the zipper disposed on the outside of the fly underflap;

(c) providing a device for retaining the tails of the shirt in the pair of pants, comprising:

(i) a first magnetic component, a second magnetic component and a third magnetic component, the first magnetic component attracted to the second magnetic component and the second magnetic component attracted to the third magnet;

(ii) a first cord connected to the first magnetic component and the second magnetic component; and (iii) a second cord connected to the second magnetic component and the third magnetic component;

(d) placing the first magnetic component between the inside of the front placket on the front tail of the shirt;

(e) placing the second magnetic component on the outside of the front placket over the first magnet such that the first magnetic component is attracted to the second magnetic component through the front placket to hold the first magnet and second magnet securely in place on the front placket; and (f) placing the third magnetic component on the outside of the fly underflap in a position adjacent to the first magnetic component and the second magnetic component, the third magnetic component attracted to the second magnetic component.

* * * * *